United States Patent [19]

Nishimura et al.

[11] 4,092,272

[45] May 30, 1978

[54] LIQUID DETERGENT COMPOSITION

[75] Inventors: Masaaki Nishimura, Sakura; Haruhiko Arai, Narashino, both of Japan

[73] Assignee: Kao Soap Co., Ltd., Tokyo, Japan

[21] Appl. No.: 713,781

[22] Filed: Aug. 12, 1976

[30] Foreign Application Priority Data

Sep. 16, 1975 Japan ..... 50-111934

[51] Int. Cl.[2] ..... C11D 3/26; C11D 3/34; C11D 7/32; C11D 7/34

[52] U.S. Cl. ..... 252/545; 252/532; 252/544; 252/551; 252/DIG. 13; 252/DIG. 14

[58] Field of Search ..... 252/551, 532, DIG. 14, 252/DIG. 13, 544, 545

[56] References Cited

U.S. PATENT DOCUMENTS

| | | | |
|---|---|---|---|
| 2,941,950 | 6/1960 | Korpi et al. | 252/551 X |
| 3,332,876 | 7/1967 | Walker | 252/551 X |
| 3,391,750 | 7/1968 | Zika | 252/551 X |
| 3,862,050 | 1/1975 | Aubert | 252/551 X |
| 3,939,100 | 2/1976 | Hau | 252/532 X |
| 4,028,280 | 6/1977 | Murata et al. | 252/551 X |

FOREIGN PATENT DOCUMENTS

| | | | |
|---|---|---|---|
| 2,203,874 | 5/1974 | Germany | 252/551 |

*Primary Examiner*—Mayer Weinblatt
*Attorney, Agent, or Firm*—Blanchard, Flynn, Thiel, Boutell & Tanis

[57] ABSTRACT

A liquid detergent composition comprising 5 to 30 % by weight of a mixture of polyoxyethylene alkyl ether sulfate salts having the formula (I):

$$RO(C_2H_4O)_nSO_3M \quad (I)$$

wherein R is alkyl containing from 8 to 18 carbon atoms and having an average carbon atom number of from 10 to 15, $n$ is a number from 1.0 to 2.6 as the average value of the mixture, with the proviso that in the mixture the content of said salts in which $n$ is zero is less than 5 % by weight, based on the total weight of the mixture of said salts, and M is alkali metal, alkaline earth metal, ammonium or an alkanol amine.

3 Claims, No Drawings

LIQUID DETERGENT COMPOSITION

BACKGROUND OF THE INVENTION

1. Field of the Invention

The present invention relates to a liquid detergent composition which has a very mild action on human skin and a very excellent washing power.

2. Description of the Prior Art

Table wares, vegetables, hair, skin and clothes made of very fine and delicate fibers such as silk, wool and acetate fibers are generally washed by hand. Accordingly, detergent compositions used for washing these objects are required to have a high washing power and a very mild action on the skin so as not to cause chapping of the skin on hands. Attempts have been made to use polyoxyethylene alkyl ether sulfate salts, having a relatively mild action on human skin, for washing these objects. However, these salts are not fully satisfactory with respect to prevention of irritation of the skin or skin chapping. Especially, these salts, in which the average mole number of added ethylene oxide units is small, tend to cause irritation of the skin or skin chapping.

Further, conventional liquid detergents comprising a polyoxyethylene alkyl ether sulfate salt are inferior in solution stability and are easily frozen at low temperatures. The solution stability is worsened in these detergents as the average alkyl chain length of these salts is increased. Accordingly, these detergents are not satisfactory for practical use.

SUMMARY OF THE INVENTION

We have discovered that when a polyoxyethylene alkyl ether sulfate salt mixture, in which the content of alkyl sulfate salt free of added ethylene oxide units ($n$ = 0) is less than 5% by weight, is used as the active detergent component of the liquid detergent composition, there is obtained a liquid detergent having a very mild action on the skin, a very excellent washing power and a very good solution stability in the solution state. The present invention is based on this discovery.

More specifically, in accordance with the present invention, there is provided a liquid detergent composition comprising 5 to 30% by weight of a mixture of polyoxyethylene alkyl ether sulfate salts having the formula (I):

$$RO(C_2H_4O)_nSO_3M \qquad (I)$$

wherein R is alkyl containing from 8 to 18 carbon atoms and having an average carbon atom number of from 10 to 15, $n$ is a number of from 1.0 to 2.6 as the average value of the mixture, with the proviso that in the mixture the content of salts in which $n$ is zero is less than 5% by weight, based on the total weight of the mixture of said salts, and M is alkali metal, alkaline earth metal, ammonium or an alkanol amine.

In the detergent composition of the present invention, the mild action on the skin and the high washing power are attained by the use of the above-mentioned specific polyoxyethylene alkyl ether sulfate salt mixture of formula (I).

The polyoxyethylene alkyl ether sulfate salt mixture of formula (I) is prepared by adding ethylene oxide to a starting alcohol, esterifying the resulting adduct with sulfuric acid and then neutralizing the ester. In this process, ethylene oxide is not added to a portion of the starting alcohol, so that said portion of the starting alcohol is directly esterified and neutralized. The resulting salt mixture contains a considerable amount of the thus formed alkyl sulfate ester, wherein $n$ is zero. This alkyl sulfate ester ($n$=zero) is highly irritative to the skin and causes skin chapping and other skin irritations. Further, this salt is inferior in solubility and an aqueous solution thereof has a high freezing point. Accordingly, a composition containing this salt is inferior in solution stability and is readily frozen at low temperature. However, if a polyoxyethylene alkyl ether sulfate salt mixture of formula (I) containing less than 5% by weight of such alkyl sulfate salt is employed, a detergent composition having a much reduced skin-irritating property and a very high washing power is obtained.

The starting alcohol for preparing the polyoxyethylene alkyl ether sulfate salt has an alkyl group containing from 8 to 18 carbon atoms and has from 10 to 15 carbon atoms on the average. The alkyl group can be linear or branched. The alcohol can be a primary, secondary or tertiary alcohol. The polyoxyethylene alkyl ether sulfate salt mixture used in the present invention, which is represented by the general formula $RO—(CH_2CH_2O)_m—SO_3M$, is synthesized from such an alcohol. It is critical that the average mole number of ethylene oxide added to the starting alcohol should be in the range of from 1 to 2.6. When the average carbon atom number of the alkyl group is below 10 or above 15, the washing power and foaming property are reduced. Further, when the average carbon number of the alkyl group is above 15, the solution stability is degraded. When the average number of added ethylene oxide mole units is larger than 2.6, the foaming property and the washing power are reduced. When the amount of the alkyl sulfate salt, in which the added ethylene oxide mole number is zero, is larger than 5% by weight, the skin irritating property and chapping-causing tendency are increased, and the stability of a solution of the resulting detergent is drastically lowered.

In short, the active organic surfactant component of the detergent composition of the present invention is a polyoxyethylene alkyl sulfate salt mixture which contains alkyl group or groups having 8 to 18 carbon atoms and having an average carbon atom number of from 10 to 15, and in which the average number of moles of added ethylene oxide units is from one to 2.6 and the content of the alkyl sulfate salt in which the mole number of added ethylene oxide is zero is less than 5% by weight. This active component has an excellent washing power, excellent solution stability and a much reduced skin-irritating property. It is especially preferred to use a salt mixture in which (1) the content of the alkyl sulfate salt having no added ethylene oxide units ($n$ is zero) is less than 5% by weight, (2) the content of the polyoxyethylene alkyl ether sulfate salts having an added ethylene oxide mole number $n$ of 1 or 2 is more than 77% by weight, and (3) the content of the polyoxyethylene alkyl ether sulfate salts having an added ethylene oxide mole number $n$ of 3 or more is less than 18% by weight.

In the ethylene oxide adduct of the starting alcohol, the unreacted alcohol (the added ethylene oxide mole number $n$ of which is zero) and the higher adduct (for example, the added ethylene oxide mole number $n$ of which is 3 or more) can easily be removed by distillation. Sulfuric acid esterification and subsequent neutralization of the ethylene oxide adduct of the starting alcohol can easily be performed according to conventional methods.

The detergent composition can contain the conventional amounts of known conventional additives for liquid detergent compositions. For example, in case of a liquid detergent, there can be used solubilizing agents such as urea, ethanol, propylene glycol, glycerin, p-toluene-sulfonic acid salts, xylene-sulfonic acid salts and naphthalene-sulfonic acid salts, auxiliary activating agents such as alkylamine oxides, alkyl pyrrolidones and fatty acid alkanol amides, washing power-improving inorganic and organic builders, enzymes, opacifying agents, colorants, preservatives and perfumes.

The present invention will now be described in detail by reference to the following Examples in which all references to "%" mean % by weight.

EXAMPLE 1

Detergent compositions as described in the following table were tested with respect to the washing power, foaming property and degree of inhibition of enzyme activity.

(1) Detergent Composition:

| | |
|---|---|
| Polyoxyethylene alkyl ether sulfate, sodium salt (as listed in Table 1) | 20% |
| Ethyl alcohol | 5% |
| Water | 75% |

(2) Washing Power Test:

A mixture (5g) of 89.5% of beef tallow, 10% of rapeseed oil and 0.5% of an oil-soluble fluorescent dye (Hakkol manufactured by Showa Denko) was applied to a dish having a diameter of 25cm. The dish was washed by rubbing it with a brush while the dish was immersed in 3.5 l of an aqueous washing solution having a concentration of said detergent composition of 0.25%, and having a temperature of 50° C. The washing power was evaluated based on the number of dishes that could be washed before there were obtained two successive dishes wherein the fluorescent dye was not removed, as determined by viewing the dishes under ultraviolet light.

(3) Foaming Property Test:

Commercially available butter was used as the contaminant and 0.1% of the contaminant was added to a detergent solution having a detergent composition concentration of 0.5%. Then, 40 cc of the butter-containing detergent solution was charged into a glass cylinder, and the solution was agitated for about 10 minutes by turning the cylinder. The foam height was measured just after the agitation was stopped.

(4) Degree of inhibition of enzyme activity:

These exists a relation between the degree of inhibition of the enzyme invertase activity of the surface active agent and the skin chapping.

The degree of inhibition of enzyme activity was measured according to the method described in "Journal of the Japan Oil Chemist's Society", 21, 3, p. 151 (1972) in the following manner:

Distilled water was added to 5 ml of an invertase solution (manufactured by BDH Chemical Ltd., 340 E.U. per milliliter) so that the total volume was 100 ml, and the resulting dilute invertase solution was added to an aqueous solution of sucrose (30% solution of saccharose of the special grade manufactured by Wako Junyaku in distilled water). A detergent was added to the resulting solution at a concentration of 1% by weight. After 3 hours, the amount of sucrose decomposed by invertase was measured and the result was compared with the result obtained when the detergent was not added.

$$\text{Degree of inhibition of enzyme activity} = \frac{\text{amount of sucrose decomposed (with detergent)}}{\text{amount of sucrose decomposed (without detergent)}} \times 100$$

A lower degree of inhibition of enzyme activity indicates that less skin chapping will occur.

(5) Stability Test:

The detergent was allowed to stand still at −5° C for 2 weeks. Detergents in which freezing or precipitation took place are indicated by X in Table 1, and detergents in which such change of the state was not observed are indicated by O.

The results of these washing power, foaming property, enzyme activity rate and stability tests are shown in Table 1.

Table 1

| Sample No. | Sodium Polyoxyethylene Alkyl Ether Sulfate: average carbon number of alkyl group | average mole number of added ethylene oxide units | content (%) of salt in which n = 0 | Washing Power (number of dishes) | Foaming Property (mm) | Degree of inhibition of enzyme activity (%) | Stability |
|---|---|---|---|---|---|---|---|
| Samples of Present invention | | | | | | | |
| 1 | 12.5 | 2.0 | 2 | 6 | 45 | 3 | O |
| 2 | 13.5 | 1.5 | 3 | 7 | 70 | 4 | O |
| Comparative Samples | | | | | | | |
| 3 | 12.5 | 2.0 | 35 | 6 | 45 | 94 | O |
| 4 | 12.5 | 3.0 | 3 | 3 | 8 | 4 | O |
| 5 | 12.5 | 3.0 | 25 | 3 | 8 | 83 | O |
| 6 | 13.5 | 1.5 | 40 | 7 | 70 | 98 | X |
| 7 | 13.5 | 3.5 | 1 | 3 | 5 | 3 | O |
| 8 | 16.0 | 2.0 | 3 | 7 | 70 | 8 | X |
| 9 | 9.0 | 2.0 | 3 | 3 | 12 | 3 | O |

As will be apparent from the foregoing test results, samples 1 and 2 according to the present invention are satisfactory with respect to all the desired properties of washing power, foaming property, degree of inhibition of enzyme activity and stability.

EXAMPLE 2

A liquid detergent having the following composition (sample 10, according to the present invention) was prepared:

| | |
|---|---|
| Sodium polyoxyethylene alkyl sulfate | 15% |

-continued

| | |
|---|---|
| ($\bar{R}$ = 13, $\bar{n}$ = 2.0, content of the salt in which n = 0 being 4 %) | |
| Lauryl diethanol amide | 5% |
| Urea | 10% |
| Ammonium chloride | 0.5% |
| Perfume | 0.3% |
| Water | balance |
| Total | 100.0% |

The washing power of this detergent was 8 dishes, the foaming property was 80 mm, the degree of inhibition of enzyme activity and the stability was good, when the tests were conducted according to the methods described in Example 1.

EXAMPLE 3

A detergent of the present invention having the following composition and a comparative detergent outside the scope of the present invention were subjected to a skin chapping test.

Detergent of Present Invention (Sample 11):

| | |
|---|---|
| Sodium polyoxyethylene alkyl sulfate | 20% |
| ($\bar{R}$ = 13.5, $\bar{n}$ = 2.0, content of the salt in which n = 0 being 2 %) | |
| Lauryl diethanol amide | 8% |
| Ethyl alcohol | 10% |
| Urea | 5% |
| Ammonium chloride | 0.5% |
| Water | balance |
| Total | 100.0% |

Comparative Detergent (Sample 12):

| | |
|---|---|
| Sodium polyoxyethylene alkyl sulfate ($\bar{R}$ = 13.5, $\bar{n}$ = 2.0, content of the salt in which n = 0 being 45 %) | 20% |
| Lauryl diethanol amide | 8% |
| Ethyl alcohol | 10% |
| Urea | 5% |
| Ammonium chloride | 0.5% |
| Water | balance |
| Total | 100.0% |

A pair comparison was conducted in which the left and right hands were immersed in the respective detergent solutions. Two test panels were used. The respective detergent solutions were reversed for the two test panels.

Number of Men of the Test Panels:

10 men for each test panel

Immersing Time:

30 minutes per day, the test being conducted on two successive days, the skin chapping being evaluated on the morning of the third day.

Detergent Concentration:

1.2% aqueous solution of the detergent composition.

Immersing Temperature:

40° C.

Evaluation:

The condition of the left hand, relative to the right hand, was evaluated according to the following scale:

+ 2: much better (less chapping)
+ 1: better
0: no difference
− 1: worse
− 2: much worse The results are shown in Table 2.

Table 2

| Combination | | Evaluation | | | | | | |
|---|---|---|---|---|---|---|---|---|
| Left Hand | Right Hand | −2 | −1 | 0 | +1 | +2 | Total Evaluation Points | Conclusion |
| Sample 11 (detergent) of present invention) | Sample 12 (comparative (detergent) | 0 | 0 | 2 | 4 | 4 | + 12 | Sample 11 outscores Sample 12 by + 23 points. |
| Sample 12 (comparative detergent) | Sample 11 (detergent of present invention) | 3 | 5 | 2 | 0 | 0 | − 11 | |

EXAMPLE 4

Liquid detergents having the following composition were prepared, and the washing power and foaming property were tested according to the methods described in Example 1.

(1) Detergent Composition:

| | |
|---|---|
| Sodium polyoxyethylene alkyl ether sulfate (See Table 3) | 25% |
| Ethyl alcohol | 5% |
| Water | 70% |

(2) Test Results:

The test results are shown in Table 3.

Table 3

| Sample No. | Sodium Polyoxyethylene Alkyl Ether Sulfate: average carbon number of alkyl group | average mole number of added ethylene oxide | polyoxyethylene mole (n) distribution (%): 0 | 1 | 2 | 3–5 | ≧6 | Washing Power (number of dishes) | Foaming Property (mm) |
|---|---|---|---|---|---|---|---|---|---|
| Samples of Present Invention | | | | | | | | | |
| 13 | 12.5 | 2.1 | 3 | 41 | 38 | 11 | 7 | 7–8 | 65 |
| 14 | 12.5 | 2.2 | 5 | 40 | 15 | 36 | 4 | 6 | 45 |
| 15 | 14.0 | 2.4 | 3 | 24 | 56 | 7 | 10 | 7–8 | 60 |
| 16 | 14.0 | 2.4 | 4 | 43 | 13 | 35 | 5 | 6 | 40 |

These detergent smaples 13 to 16 were tested also with respect to the stability and degree of inhibition of enzyme activity sample had a good stability (o) and the degree of inhibition of enzyme activity was in the range of 3 to 4% in each sample.

The embodiments of the invention in which an exclusive property or privilege is claimed are defined as follows:

1. A liquid detergent composition consisting essentially of an aqueous solution containing 5 to 30 percent by weight of a mixture of polyoxyethylene alkyl ether sulfate salts which was prepared by adducting ethylene oxide to a starting alcohol, distilling the resulting adduct reaction product to remove unreacted alcohol and adduct compounds having 3 or more moles of adducted ethylene oxide, then esterifying the remaining adduct reaction product with sulfuric acid, and then neutralizing the esterified adduct reaction product to obtain said mixture of polyoxyethylene alkyl ether sulfates having the formula $$RO(CH_2CH_2O)_nSO_3M$$

wherein R is alkyl having from 8 to 18 carbon atoms and the average carbon atom number of R for the mixture is from 10 to 15, the average value of $n$ for the mixture is from 1.0 to 2.6 with the proviso that the content of salts in which (1) $n$ is zero is less than 5 percent by weight, (2) $n$ is 3 or more is less than 18 percent by weight and (3) $n$ is one or 2 is more than 77 percent by weight, all percentages being based on the total weight of said mixture, and M is alkali metal, alkaline earth metal, ammonium or alkanol amine, and the balance is essentially water.

2. A liquid detergent composition as claimed in claim 1 in which M is sodium.

3. A liquid detergent composition as claimed in claim 1 in which the average value of $n$ is from about 1.5 to about 2.0 and in which the average carbon atom number of R is from 12.5 to 14.0.

* * * * *